US006680703B1

(12) United States Patent
McConnell

(10) Patent No.: US 6,680,703 B1
(45) Date of Patent: Jan. 20, 2004

(54) METHOD AND APPARATUS FOR OPTIMALLY TUNING A CIRCULARLY POLARIZED PATCH ANTENNA AFTER INSTALLATION

(75) Inventor: Richard Joseph McConnell, Rancho Cucamonga, CA (US)

(73) Assignee: SiRF Technology, Inc., San Jose, CA (US)

( * ) Notice: Subject to any disclaimer, the term of this patent is extended or adjusted under 35 U.S.C. 154(b) by 0 days.

(21) Appl. No.: 10/078,192

(22) Filed: Feb. 14, 2002

Related U.S. Application Data

(60) Provisional application No. 60/269,390, filed on Feb. 16, 2001.

(51) Int. Cl.[7] ..... H01Q 1/38
(52) U.S. Cl. ..... 343/700 MS; 343/745
(58) Field of Search ..... 343/700 MS, 745, 343/829, 830, 846, 749

(56) References Cited

U.S. PATENT DOCUMENTS

| | | | | |
|---|---|---|---|---|
| 4,426,712 A | | 1/1984 | Gorski-Popiel | 375/96 |
| 4,445,118 A | | 4/1984 | Taylor et al. | 343/357 |
| 4,463,357 A | | 7/1984 | MacDoran | 343/460 |
| 4,529,987 A | * | 7/1985 | Bhartia et al. | 343/700 MS |
| 4,578,678 A | | 3/1986 | Hurd | 343/357 |
| 4,667,203 A | | 5/1987 | Counselman, III | 342/357 |
| 4,701,934 A | | 10/1987 | Jasper | 375/1 |
| 4,754,465 A | | 6/1988 | Trimble | 375/1 |
| 4,780,724 A | * | 10/1988 | Sharma et al. | 343/700 MS |
| 4,785,463 A | | 11/1988 | Janc et al. | 375/1 |
| 4,809,005 A | | 2/1989 | Counselman, III | 342/352 |
| 4,821,294 A | | 4/1989 | Thomas, Jr. | 375/96 |
| 4,890,233 A | | 12/1989 | Ando et al. | 364/457 |
| 4,894,662 A | | 1/1990 | Counselman | 342/357 |
| 4,998,111 A | | 3/1991 | Ma et al. | 342/352 |
| 5,014,066 A | | 5/1991 | Counselman, III | 342/352 |
| 5,036,329 A | | 7/1991 | Ando | 342/357 |
| 5,043,736 A | | 8/1991 | Darnell et al. | 342/357 |
| 5,108,334 A | | 4/1992 | Eschenbach et al. | 455/314 |
| 5,202,829 A | | 4/1993 | Geier | 364/449 |
| 5,225,842 A | | 7/1993 | Brown et al. | 342/357 |
| 5,293,170 A | | 3/1994 | Lorenz et al. | 342/352 |
| 5,311,195 A | | 5/1994 | Mathis et al. | 342/357 |
| 5,323,164 A | | 6/1994 | Endo | 342/357 |
| 5,343,209 A | | 8/1994 | Sennott et al. | 342/357 |
| 5,345,244 A | | 9/1994 | Gildea et al. | 342/357 |
| 5,347,536 A | | 9/1994 | Meehan | 375/1 |
| 5,379,224 A | | 1/1995 | Brown et al. | 364/449 |
| 5,402,347 A | | 3/1995 | McBurney et al. | 364/443 |
| 5,416,712 A | | 5/1995 | Geier et al. | 364/450 |
| 5,420,593 A | | 5/1995 | Niles | 342/357 |
| 5,440,313 A | | 8/1995 | Osterdock et al. | 342/352 |
| 5,450,344 A | | 9/1995 | Woo et al. | 364/449 |
| 5,504,684 A | | 4/1996 | Lau et al. | 364/443 |
| 5,511,238 A | * | 4/1996 | Bayraktaroglu | 343/700 MS |
| 5,592,173 A | | 1/1997 | Lau et al. | 342/357 |
| 5,625,668 A | | 4/1997 | Loomis et al. | 379/58 |

(List continued on next page.)

FOREIGN PATENT DOCUMENTS

| | | | |
|---|---|---|---|
| EP | 0511741 | 11/1992 | G01S/5/08 |
| GB | 2115195 | 1/1983 | H04B/1/00 |
| JP | 58-105632 | 6/1983 | |
| JP | 7-36035 | 5/1986 | G01S/5/14 |
| JP | 4-326079 | 11/1992 | G01S/5/14 |
| WO | WO 90/11652 | 10/1990 | H04B/1/16 |

*Primary Examiner*—Hoang V. Nguyen
(74) *Attorney, Agent, or Firm*—The Eclipse Group

(57) ABSTRACT

The present invention provides methods and apparatuses for tuning a circularly polarized patch antenna to compensate for manufacturing tolerance variation, and to compensate for mistuning of the antenna due to the implementation of the product in which the antenna is used. Varactors are coupled to the metal patch portion of the antenna, and a dc voltage is applied to tune the antenna capacitance. The varactors can receive different voltages if desired.

12 Claims, 5 Drawing Sheets

U.S. PATENT DOCUMENTS 5,663,734 A 9/1997 Krasner ..... 342/357
5,663,735 A 9/1997 Eshenbach ..... 342/357
5,781,156 A 7/1998 Krasner ..... 342/357
5,786,789 A 7/1998 Janky ..... 342/357
5,812,087 A 9/1998 Krasner ..... 342/357
5,825,327 A 10/1998 Krasner ..... 342/357
5,828,694 A 10/1998 Schipper ..... 375/208
5,831,574 A 11/1998 Krasner ..... 342/357
5,841,396 A 11/1998 Krasner ..... 342/357
5,845,203 A 12/1998 LaDue ..... 455/414
5,854,605 A 12/1998 Gildea ..... 342/357
5,874,914 A 2/1999 Krasner ..... 342/357
5,877,724 A 3/1999 Davis ..... 342/357
5,877,725 A 3/1999 Kalafus ..... 342/357
5,883,594 A 3/1999 Lau ..... 342/357
5,884,214 A 3/1999 Krasner ..... 701/207
5,889,474 A 3/1999 LaDue ..... 340/825.49
5,903,654 A 5/1999 Milton et al. ..... 380/49
5,907,809 A 5/1999 Molnar et al. ..... 455/456
5,917,444 A 6/1999 Loomis et al. ..... 342/357
5,920,283 A 7/1999 Shaheen et al. ..... 342/357
5,923,703 A 7/1999 Pon et al. ..... 375/209
5,926,131 A 7/1999 Sakumoto et al. ..... 342/357
5,936,572 A 8/1999 Loomis et al. ..... 342/357
5,943,363 A 8/1999 Hanson et al. ..... 375/206
5,945,944 A 8/1999 Krasner ..... 342/357.06
5,963,582 A 10/1999 Stansell, Jr. ..... 375/200
5,977,909 A 11/1999 Harrison et al. ..... 342/357.09
5,982,324 A 11/1999 Watters et al. ..... 342/357.06
5,987,016 A 11/1999 He ..... 370/335
5,999,124 A 12/1999 Sheynblat ..... 342/357.09
6,002,362 A 12/1999 Gudat ..... 342/357.03
6,002,363 A 12/1999 Krasner ..... 342/357.1
6,009,551 A 12/1999 Sheynblat ..... 714/776
6,016,119 A 1/2000 Krasner ..... 342/357.06
6,041,222 A 3/2000 Horton et al. ..... 455/255
6,047,017 A 4/2000 Cahn et al. ..... 375/200
6,052,081 A 4/2000 Krasner ..... 342/357.02
6,061,018 A 5/2000 Sheynblat ..... 342/357.06
6,064,336 A 5/2000 Krasner ..... 342/357.05
6,104,338 A 8/2000 Krasner ..... 342/357.06
6,104,340 A 8/2000 Krasner ..... 342/357.1
6,107,960 A 8/2000 Krasner ..... 342/357.09
6,111,540 A 8/2000 Krasner ..... 342/357.1
6,131,067 A 10/2000 Girerd et al. ..... 701/213
6,133,871 A 10/2000 Krasner ..... 342/357.06
6,133,873 A 10/2000 Krasner ..... 342/357.12
6,133,874 A 10/2000 Krasner ..... 342/357.15
6,150,980 A 11/2000 Krasner ..... 342/357.1

* cited by examiner

METHOD AND APPARATUS FOR OPTIMALLY TUNING A CIRCULARLY POLARIZED PATCH ANTENNA AFTER INSTALLATION

CROSS-REFERENCE TO RELATED APPLICATIONS

This application claims priority under 35 U.S.C.§119(e) of U.S. Provisional Patent Application No. 60/269,390, filed Feb. 16, 2001, entitled "METHOD AND APPARATUS FOR OPTIMALLY TUNING A CIRCULAR POLARIZED PATCH ANTENNA AFTER INSTALLATION," by Richard J. McConnell et al, which application is incorporated by reference herein.

BACKGROUND OF THE INVENTION

1. Field of the Invention.

The present invention relates in general to radio frequency (RF) antennas, and, in particular, to dynamically optimizing the performance of a circularly polarized antenna.

2. Description of the Related Art.

The use of RF electronics has become commonplace in many facets of modem living, e.g., cellular telephones, satellite communications, television reception, computers, etc. Many of today's RF signals are transmitted in a wireless fashion, which requires the use of transmitting and receiving antennas to perform such tasks.

As many RF devices become smaller, antenna design has become very important because of the antenna's important role in the communications link. Without a properly tuned antenna, or an antenna that properly uses the gain properties associated with such an antenna, the communications link can be lost or unreliable, making the RF electronic device unusable in certain situations. Many small RF devices use patch antennas because of their small size and ease of integration for packaging of the RF device. For satellite signal reception, e.g., Global Positioning System (GPS) satellite signals, circularly polarized patch antennas are used extensively.

Even with the attractiveness of the patch antenna size and ease of integration, there remain a number of difficulties with the implementation of these antennas. The small size of the patch antenna is typically achieved by making the patch antennas thin and increasing the dielectric constant of the dielectric material between the upper and lower plates of the antenna. However, as the antenna shrinks in size, the bandwidth of the antenna decreases. With narrower bandwidth antennas, precise tuning of the antennas becomes necessary, or the antenna will not be able to receive or transmit the signal of interest.

Patch antennas, because of their thin nature, material makeup, and small size, are also more susceptible to changes in surrounding environment than other types of antennas. Patch antennas can be mistuned by nearby plastics, metal, and even the near proximity of the user.

As such, environmental effects, such as mistuning and bandwidth narrowing, can seriously degrade the performance of the antenna, and make implementing designs in a low cost product very difficult. It is often necessary to have antenna manufacturers tune the antennas for a specific product, and the yield of this tuning may still cause a large amount of unit-to-unit variation. It is desirable to be able to tune each antenna after placement into the device if possible to allow for manufacturing tolerances in the antenna and the housing to be compensated for. Further, once the antenna has been installed and the RF electronic device delivered to a user, the antenna should be tunable by the user to compensate for other environmental effects not seen at the manufacturer's facility.

Tuned antennas, and methods of tuning antennas exist in the literature. U.S. Pat. Nos. 5,943,016, 6,005,519, and 6,061,025, which are all incorporated by reference herein, describe methods to tune the antenna by adding to the metal areas of the patch. Such an approach would not be acceptable for antennas that have already been installed in a device. U.S. Pat. No. 5,777,581, which is incorporated by reference herein, describes a method, such as described above, but the metal areas to be added are done so through switching diodes, which allows for dynamic changes in the electric field. U.S. Pat. No. 4,529,980, which is incorporated herein by reference, describes using varactor diodes to tune a linear antenna. Such methods are not acceptable or directly applicable to conveniently tune a circularly polarized patch antenna.

It can be seen, then, that there is a need in the art for a method and apparatus to easily tune the antenna to allow for greater antenna manufacturing tolerances. It can also be seen that there is a need in the art for a method and apparatus to compensate for variations in the antenna caused by the physical properties of the application using the antenna. It can also be seen that there is a need in the art for a method and apparatus that can accomplish, to the extent possible, both tuning the antenna to allow for greater manufacturing tolerances, and compensation for variations caused by the physical properties of the application using the antenna. It can also be seen that there is a need in the art for a method and apparatus that can compensate for variations after the antenna is installed in the housing of the intended application. It can also be seen that there is a need in the art for optimizing the antenna performance and reduce or eliminate the variations in performance after deployment of the RF device.

SUMMARY OF THE INVENTION

To minimize the limitations in the prior art, and to minimize other limitations that will become apparent upon reading and understanding the present specification, the present invention discloses a method and apparatus for a method to be able to dynamically tune a circularly polarized patch so that when installing the antenna during the manufacture of an assembly, and in the field, the unit can optimize the antenna performance and reduce or eliminate the variations in performance.

An apparatus in accordance with the present invention comprises a first varactor and a second varactor. The first varactor has a first terminal that is coupled to the metal patch of the circularly polarized patch antenna at a first point and has a second terminal that is coupled to ground. The second varactor has a first terminal that is coupled to the metal patch of the circularly polarized patch antenna at a second point and has a second terminal that is coupled to ground. Application of a varying DC voltage to the pin of the circularly polarized patch antenna tunes the first varactor and the second varactor coupled to the circularly polarized patch antenna, and hence tunes the antenna as installed.

It is an object of the present invention to provide a method and apparatus to easily tune the antenna to allow for greater antenna manufacturing tolerances. It is an object of the present invention to provide a method and apparatus to compensate for variations in the antenna caused by the physical properties of the application using the antenna. It is an object of the present invention to provide a method and apparatus that can accomplish, to the extent possible, both tuning the antenna to allow for greater manufacturing tolerances, and compensation for variations caused by the physical properties of the application using the antenna. It is an object of the present invention to provide a method and apparatus that can compensate for variations after the antenna is installed in the housing of the intended application. It is an object of the present invention to optimize the antenna performance and reduce or eliminate the variations in performance after deployment of the RF device.

BRIEF DESCRIPTION OF THE DRAWINGS

Referring now to the drawings in which like reference numbers represent corresponding parts throughout.

DETAILED DESCRIPTION OF THE DRAWINGS

In the following description of the preferred embodiment, reference is made to the accompanying drawings which form a part hereof, and in which is shown byway of illustration a specific embodiment in which the invention may be practiced. It is to be understood that other embodiments may be utilized and structural changes may be made without departing from the scope of the present invention.

Overview

This invention provides methods and apparatuses for tuning a circularly polarized patch antenna to compensate for manufacturing tolerance variation, and to compensate for mistuning of the antenna due to the implementation of the product in which the antenna is used.

System Overview

Many systems, especially satellite-based systems, communicate with radio signals that are circularly polarized. Circular polarization of transmitted RF signal means that the polarization of the signal rotates through 360 degrees for every wavelength of the signal, perpendicularly to the direction of transmission. For example if a circularly polarized signal is being transmitted between two points, and a linear dipole antenna is placed in any orientation in a plane perpendicular to the line of travel of the signal, the antenna will receive the same power (i.e., signal strength) no matter how it is rotated in this plane. Two crossed dipoles will pick up the same power at the same time, but different by 90 degrees of phase. This is because the signal is rotating phase by 360 degrees through this plane for each wavelength that passes through the plane. If the output of one dipole is changed in phase by 90 degrees in the correct direction, then it can be added to the output of the other dipole, and the resultant power is twice that received by a single dipole antenna.

Where satellites are communicating with terrestrial receivers, if a crossed polarization condition occurs, where the transmitted satellite power is rotated ninety degrees from the receive antenna polarization, no signal power is observed at the terrestrial receiver, which would render the terrestrial receiver useless in such a condition. If circularly polarized signals are transmitted, a signal will always be received at the terrestrial receiver, and the receiver will have twice the signal strength if the receive antenna is circularly polarized. In systems with marginal link budgets receiving twice the power is quite desirable.

If a circularly polarized receive antenna is used in such a system, but the antenna is mistuned, most or all of the advantage of the extra power gain is lost. As described above, the antenna size is also of concern, especially in portable applications, and patch antennas fulfill this criterion. Unfortunately small patches are very sensitive to manufacturing process, and are mistuned by materials placed around them.

This invention presents a method to tune the antenna after it has been installed, so that it can operate optimally.

Detailed Description

Figure 1:
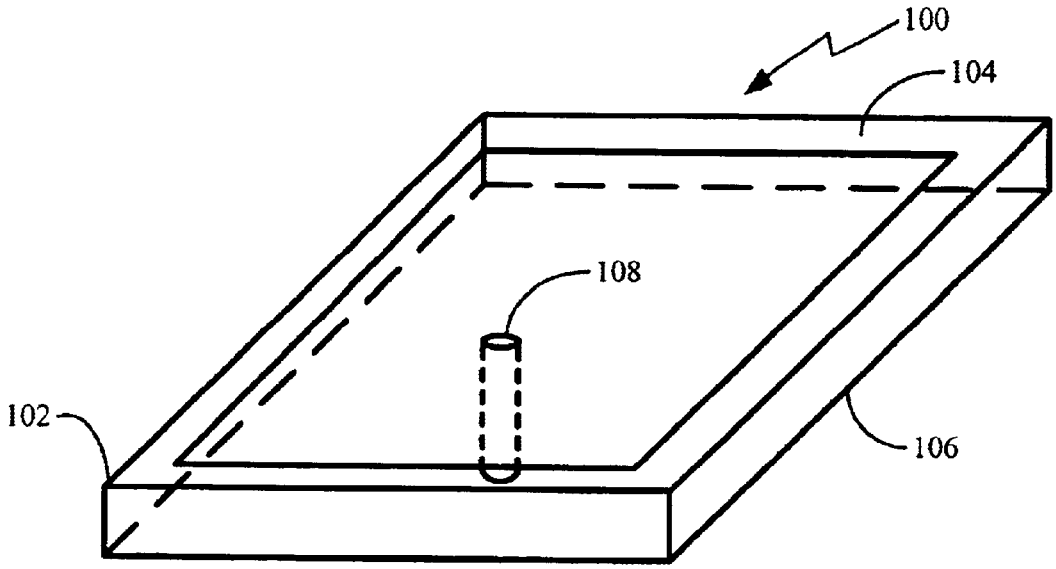
FIG. 1 illustrates a typical circularly polarized patch antenna.

FIG. 1 illustrates a typical circularly polarized patch antenna. Antenna 100 comprises dielectric 102 with metal patch 104 deposited thereon. Bottom 106 of dielectric 102 is typically also metallized. Pin 108 is electrically connected to the metal patch 104, however, pin 108 is not electrically connected to the dielectric 102 or any metallization on the bottom 106. Pin 108 is typically metal, but can be any electrically conductive material.

In a typical application, the bottom 106 metalization is connected to an attached circuit ground, and pin 108 is connected to a low noise amplifier's input.

Figure 2:
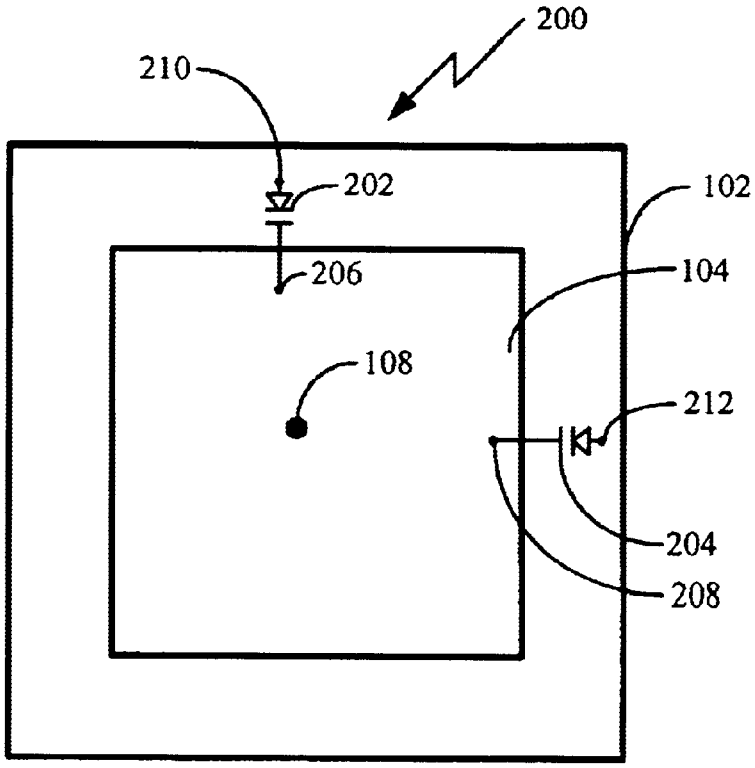
FIG. 2 illustrates a system in accordance with the present invention.

FIG. 2. illustrates a system in accordance with the present invention.

System 200 comprises varactors 202 and 204. Varactor 202 is electrically connected to metal patch 104 at point 206. Varactor 204 is electrically connected to metal patch 104 at point 208. Varactor 202 is electrically connected through the dielectric 102 to ground, which is typically the metallization on bottom 106, at point 210. Varactor 204 is electrically connected through the dielectric 102 to ground, which is typically the metallization on bottom 106, at point 212. System 200 can be tuned by applying a varying dc voltage to pin 108. Varactors 202 and 204 can be electrically connected to ground without being connected through the dielectric 102 if desired.

Figure 3:
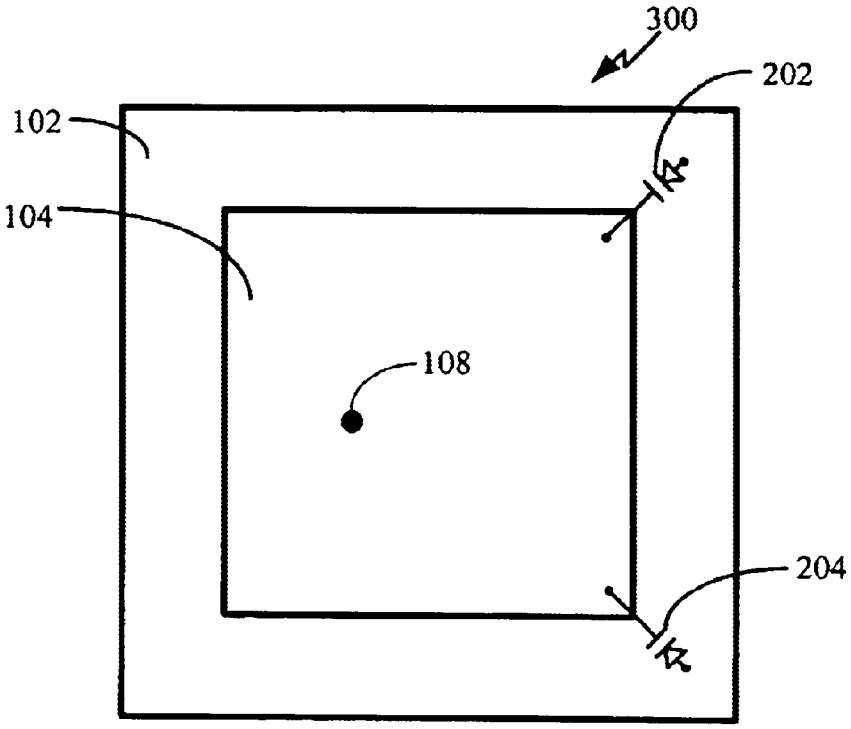
FIG. 3 illustrates a system in accordance with the present invention that utilizes a different placement of the varactors.

FIG. 3 illustrates system 300, which utilizes a different placement of the varactors 202 and 204. The varactors 202 and 204 can be placed at number of other places around the metal patch 104, and still function to tune the metal patch 104.

Figure 4:
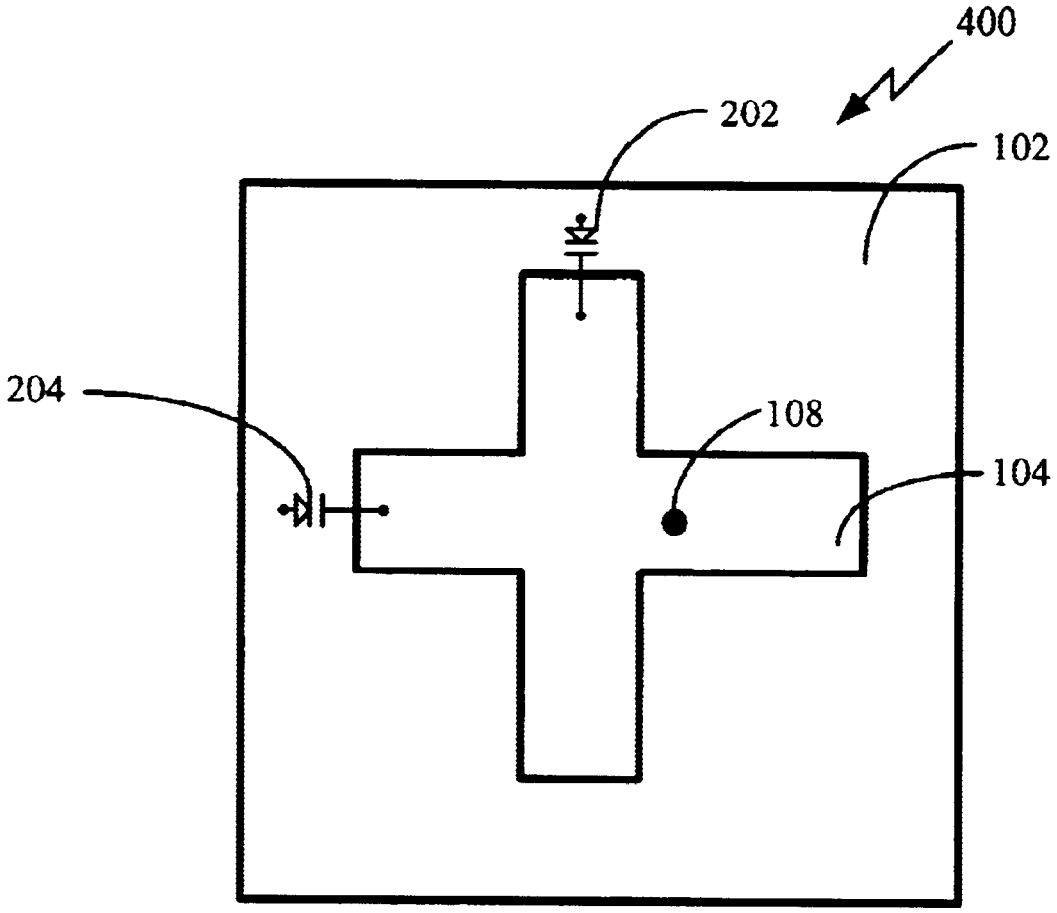
FIG. 4 illustrates a system in accordance with the present invention that uses a metal patch implemented as a pair of crossed half wave dipoles.

FIG. 4 illustrates a system 400 using a metal patch 104 implemented as a pair of crossed half wave dipoles. As shown in FIG. 4, the varactors 202 and 204 can be coupled to metal patch 104 shaped as a pair of crossed half wave dipoles, and can still be used to tune such a system 400. Many other embodiments of patch antennas, utilizing different shapes of metal patches 104, and with or without metallization on bottom 106, can be tuned using the present invention.

Figure 5:
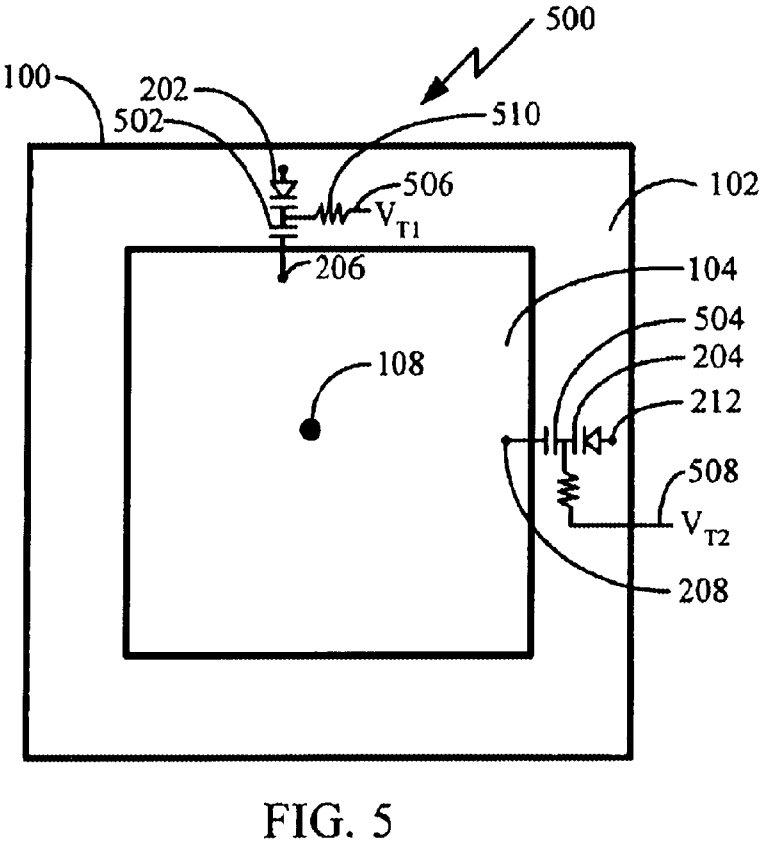
FIG. 5 illustrates a system in accordance with the present invention that allows for independent tuning of the varactors.

FIG. 5 illustrates a system in accordance with the present invention that allows for independent tuning of the varactors. System 500 comprises patch antenna 100, varactors 202 and 204, and capacitors 502 and 504. Tuning voltages VT1 506 and VT2 508 are applied to system 500, where VT1 506 is applied through resistor 510 to the junction of varactor 202 and capacitor 502, and VT2 508 is applied through resistor 512 to the junction of varactor 204 and capacitor 504. Capacitors 502 and 504 act as isolators to isolate VT1 506 from VT2 508.

Figure 6:
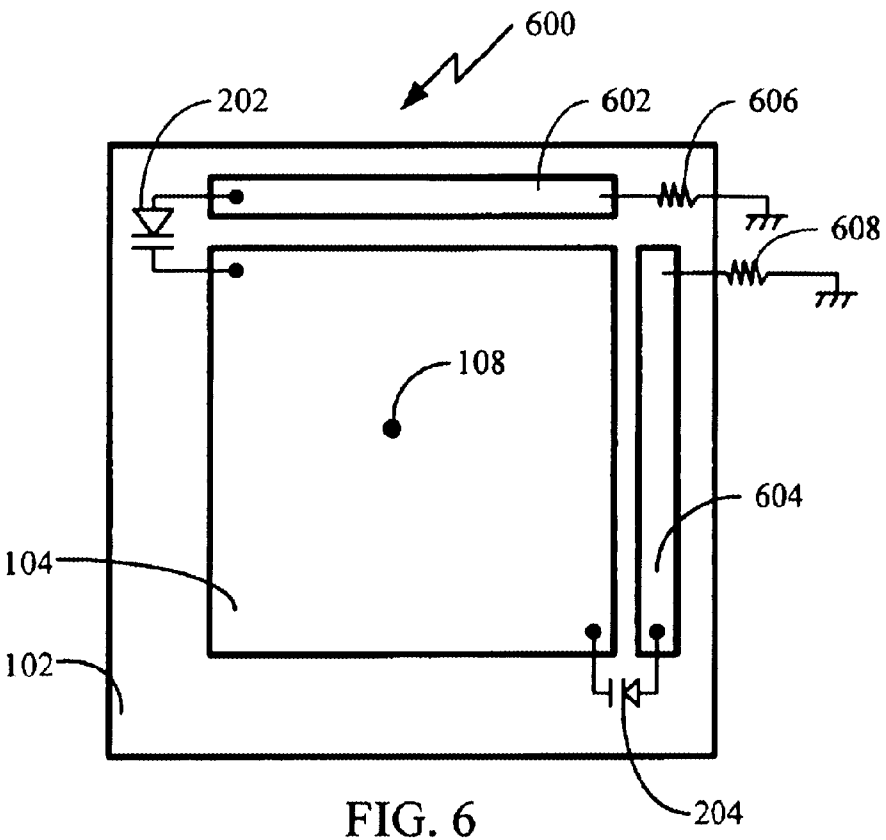
FIG. 6 illustrates another apparatus for tuning the varactors in accordance with the present invention.

FIG. 6 illustrates another apparatus for tuning the varactors in accordance with the present invention. System 600 comprises varactor 202 coupled to metal strip 602, and varactor 204 coupled to metal strip 604. Metal strips 602 and 604 are capacitively coupled to ground and can be viewed as capacitors in series with the varactors 202 and 204, or extensions of the metal patch 104. Resistors 606 and 608 are added to provide a connection to ground for the dc turning voltage, but block the RF and present an effective open circuit at the RF frequency.

Figure 7:
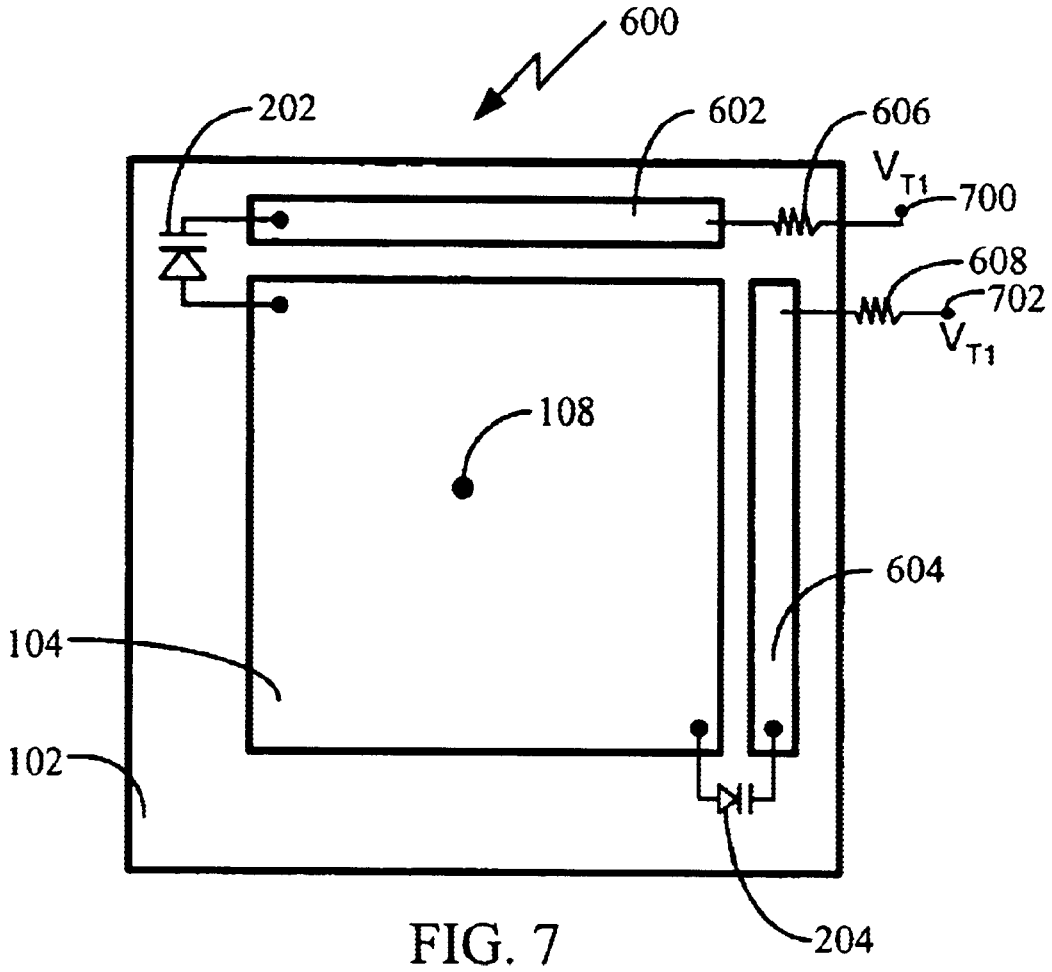
FIG. 7 illustrates the implementation of FIG. 6 modified for independent tuning of the varactors in accordance with the present invention.

FIG. 7 illustrates the implementation of FIG. 6 modified for independent tuning of the varactors in accordance with the present invention. Tuning voltage VT1 700 passes through resistor 606 to be applied to varactor 202. Tuning voltage VT2 702 passes through resistor 608 to be applied to varactor 204. Pin 108 is held at ground potential for the dc tuning voltage. Varactors 202 and 204 are mounted in the opposite polarity from their mounting in FIG. 6.

Conclusion

The present invention provides methods and apparatuses for tuning a circularly polarized patch antenna to compensate for manufacturing tolerance variation, and to compensate for mistuning of the antenna due to the implementation of the product in which the antenna is used.

An apparatus in accordance with the present invention comprises a first varactor and a second varactor. The first varactor has a first terminal that is coupled to the metal patch of the circularly polarized patch antenna at a first point and has a second terminal that is coupled to ground. The second varactor has a first terminal that is coupled to the metal patch of the circularly polarized patch antenna at a second point and has a second terminal that is coupled to ground. Application of a varying DC voltage to the pin of the circularly polarized patch antenna tunes the first varactor and the second varactor coupled to the circularly polarized patch antenna, and hence tunes the antenna as installed.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims appended hereto.

What is claimed is:

1. An apparatus for tuning a circularly polarized patch antenna, wherein the circularly polarized patch antenna comprises a metal patch, a dielectric layer, a metallization layer, and a pin, the apparatus comprising:

a first varactor, wherein a first terminal of the first varactor is coupled to the metal patch of the circularly polarized patch antenna at a first point and a second terminal of the first varactor is coupled to ground;

a second varactor, wherein a first terminal of the second varactor is coupled to the metal patch of the circularly polarized patch antenna at a second point and a second terminal of the second varactor is coupled to ground; and a first capacitor, a second capacitor, a first resistor, and a second resistor, wherein the first capacitor and the first resistor are coupled to the first varactor, and the second capacitor and the second resistor are coupled to the second varactor, and a first voltage is applied to the first resistor to tune the first varactor and a second voltage is applied to the second resistor to tune the second varactor.

2. The apparatus of claim 1, wherein the first capacitor comprises a metal strip.

3. The apparatus of claim 2, wherein the second capacitor is a metal strip.

4. The apparatus of claim 3, wherein the first varactor and the second varactor are installed in a first polarity.

5. The apparatus of claim 3, wherein the first varactor and the second varactor are installed in a second polarity opposite to that of the first polarity.

6. A method for tuning a circularly polarized antenna, comprising:

installing a first varactor between a metal patch of the circularly polarized antenna and ground at a first point on the metal patch of the circularly polarized antenna;

installing a second varactor between the metal patch of the circularly polarized antenna and ground at a second point on the metal patch of the circularly polarized antenna;

coupling the a first capacitor and a first resistor to the first varactor;

coupling the second capacitor and the second resistor to the second varactor;

applying a first voltage to the first resistor to tune the first varactor; and applying a second voltage to the second resistor to tune the second varactor.

7. The method of claim 6, wherein ground comprises a metallization layer of the circularly polarized patch antenna.

8. The method of claim 7, wherein the first varactor is coupled through a dielectric layer of the circularly polarized patch antenna.

9. The method of claim 8, wherein the second varactor is coupled through the dielectric layer of the circularly polarized patch antenna.

10. The apparatus of claim 9, wherein the metal patch of the circularly polarized patch antenna is a pair of crossed half-wave dipoles.

11. The method of claim 9, wherein the metal patch of the circularly polarized patch antenna is of arbitrary shape.

12. The method of claim 11, wherein the first varactor and the second varactor can be independently tuned.

* * * * *